US007770303B2

(12) United States Patent
Graham et al.

(10) Patent No.: US 7,770,303 B2
(45) Date of Patent: Aug. 10, 2010

(54) MARKING TEMPLATE

(76) Inventors: Kym Joanne Graham, 11 Daru Avenue, Runaway Bay, Queensland 4216 (AU); Ann Margaret Duncan, 25 Drake Avenue, Paradise Point, Queensland 4216 (AU)

( * ) Notice: Subject to any disclaimer, the term of this patent is extended or adjusted under 35 U.S.C. 154(b) by 58 days.

(21) Appl. No.: 11/792,852

(22) PCT Filed: Dec. 8, 2005

(86) PCT No.: PCT/AU2005/001862

§ 371 (c)(1),
(2), (4) Date: Jun. 17, 2008

(87) PCT Pub. No.: WO2006/063384

PCT Pub. Date: Jun. 22, 2006

(65) Prior Publication Data

US 2009/0113737 A1 May 7, 2009

(30) Foreign Application Priority Data

Dec. 13, 2004 (AU) ..... 2004907082

(51) Int. Cl.
*G01B 3/14* (2006.01)

(52) U.S. Cl. ..... 33/562; 33/563

(58) Field of Classification Search ..... 33/563, 33/566, 567, 1 B

See application file for complete search history.

(56) References Cited

U.S. PATENT DOCUMENTS

| | | | | | |
|---|---|---|---|---|---|
| 2,559,015 | A | * | 7/1951 | Graff | 33/1 B |
| 3,795,053 | A | * | 3/1974 | Burke | 33/1 B |
| 4,461,086 | A | * | 7/1984 | Segletes | 33/564 |
| 4,530,156 | A | * | 7/1985 | Kettlestrings | 33/27.01 |
| 5,577,328 | A | * | 11/1996 | Kerry, Sr. | 33/563 |
| 5,791,062 | A | * | 8/1998 | Walker | 33/563 |
| D508,861 | S | * | 8/2005 | Zavala | D10/64 |
| D511,961 | S | * | 11/2005 | Jordan | D8/354 |
| 7,255,051 | B2 | * | 8/2007 | Graham et al. | 112/103 |
| 7,543,388 | B2 | * | 6/2009 | Christensen et al. | 33/194 |
| D601,442 | S | * | 10/2009 | Haren | D10/64 |
| 2001/0045022 | A1 | * | 11/2001 | Lariviere et al. | 33/562 |
| 2005/0252019 | A1 | * | 11/2005 | Gordon et al. | 33/566 |
| 2009/0025245 | A1 | * | 1/2009 | Brady | 33/562 |

FOREIGN PATENT DOCUMENTS

| | | |
|---|---|---|
| CA | 2202805 | 10/1997 |
| DE | 3230237 | 3/1983 |
| EP | 318439 | 5/1989 |

* cited by examiner

*Primary Examiner*—G. Bradley Bennett
*Assistant Examiner*—Tania C Courson
(74) *Attorney, Agent, or Firm*—Hoffman, Wasson & Gitler, P.C.

(57) ABSTRACT

A marking template comprising a planar body portion having a central aperture, and a plurality of sets of apertures in the body portion, each set of apertures located a predetermined distance from the central aperture which enable rectangular patterns to be marked on a workpiece.

12 Claims, 1 Drawing Sheet

MARKING TEMPLATE

TECHNICAL FIELD

This invention relates to templates and devices for assisting the processes of marking out prior to sewing, embroidery and particularly patchwork.

BACKGROUND ART

The creation of regular sewing or embroidery patterns and designs is artful.

The process is assisted by the use of various types of patterns, templates, rulers and apparatus such as circular sewing attachments.

Whilst such apparatus and implements are helpful, the production of regular and consistent results is not always assured and the quality of work remains dependant upon operator skill.

The inventors of the present invention have been active in this area previously and have invented a template to assist the process of circular sewing and embroidery. This prior art template comprises a disc-like body having a central aperture, segmental and circular markings on the body and a plurality of apertures in the body coinciding with intersecting points of the markings on the body which enable centrepoint positions for circular, arcuate and other patterns to be marked on a workpiece.

This template was particularly designed to assist the process marking out prior to sewing, embroidery and particularly patchwork.

DISCLOSURE OF INVENTION

The present invention is directed to a marking template which may at least partially overcome at least one of the abovementioned disadvantages or provide the consumer with a useful or commercial choice.

According to one aspect of the present invention, there is provided a marking template comprising a planar body portion having a central aperture and a plurality of sets of apertures in the body portion, each set of apertures located a predetermined distance from the central aperture which enables rectangular patterns to be marked on a workpiece.

The template will typically be used when marking out a pattern or area on a piece of fabric or similar prior to cutting the fabric or sewing. The template of the invention is particularly well suited to use in the field of patchwork and quilting where it can be used to quickly and accurately mark out the size of the backing squares to be joined in the patchwork process.

The planar body portion of the template will generally be manufactured of a plastic material. The template can be easily stamped or cut from a larger sheet of plastic. Typically, the plastic will be at least partially transparent so the fabric or workpiece can be viewed through the template when it is in place on the fabric or workpiece.

The body portion will preferably be rigid and approximately up to 5 mm thick. It will suitably be substantially rectangular in shape and most preferably, the body portion will be square. The body portion may be of any dimension but a preferred embodiment of the template will be square having 17 inch sides.

The body portion has a central aperture. The central aperture will preferably be a circular opening or hole extending through the body portion.

The template includes a plurality of sets of apertures in the body portion. The members of a particular set will typically be located one in each of the four cardinal directions with respect to the body portion.

Each particular set may include an aperture located in each of the four inter-cardinal directions with respect to the body portion. A particularly preferred embodiment of the template according to the invention may include a plurality of sets of apertures in which apertures of each particular set are provided in both the four cardinal directions and the four inter-cardinal directions with respect to the body portion.

The apertures located in the inter-cardinal directions will preferably be substantially L-shaped openings, oriented concentrically with and nearest to the corner of the body portion. The apertures will typically extend through the body portion. The aperture may therefore be L-shaped slits or slots.

The sets of apertures may be provided identifying a 16 inch marking zone and be spaced apart to a 12 inch marking zone. Each of the sets of apertures are preferably separated by a predetermined or standard distance, either metric or preferably imperial. According to a particularly preferred embodiment, the spacing between the apertures of adjacent sets of apertures will be approximately ½ inch.

There may be additional markings on the body portion of the template according to the invention.

Preferably, there may be at least one concentric rectangular marking on the body portion. Typically, the concentric markings will extend between the sets of apertures in the body portion, thereby identifying a standard square shape (according to a preferred embodiment) of a particular size and the bounds of said shape in all directions.

There may be additional markings on the body portion in the form of lines marked extending from the central aperture in each of the cardinal directions. Major markings can be provided at 90 degree spacings to define four major areas of the body. The provision of these markings has the effect of delineating smaller shapes on the body portion.

There may be additional markings provided between major markings in the inter-cardinal directions. These additional markings can be provided at 45 degree spacings to the major markings.

Additionally, there may be one or more rectangular or preferably square shapes marked on the template with the corner points of these shapes coinciding with the 12 inch apertures on the cardinal markings. The rectangular shapes may therefore appear to be rotated 45 degrees to the other markings on the body portion.

There may also be one or more additional apertures or holes oriented on these marked lines. The additional apertures will generally be regularly spaced to define shapes which differ in size by approximately 1 inch or ½ inch depending upon preference.

There may be openings located at the intersections of the side lines of the rectangular shapes and the inter-cardinal lines.

There are suitably apertures spaced at increments on at least one inter-cardinal line starting from intersections of the side lines of the rectangular shapes and the inter-cardinal lines and terminating inside the 12 inch markings and apertures. The apertures preferably define shapes which differ in size by approximately 1 inch or ½ inch depending upon preference.

According to a further aspect of the present invention there is provided a method of forming a pattern on fabric comprising the steps of:

(a) positioning a rectangular marking template relative to a workpiece, (b) marking a centre position on a workpiece using the template device as aforesaid, (c) marking other strategic points on the workpiece, and (d) sewing onto the workpiece to a desired design or pattern.

BRIEF DESCRIPTION OF THE DRAWINGS

Aspects of the present invention will now be described with reference to the accompanying drawings in which.

DETAILED DESCRIPTION OF THE PREFERRED EMBODIMENT

Figure 1:
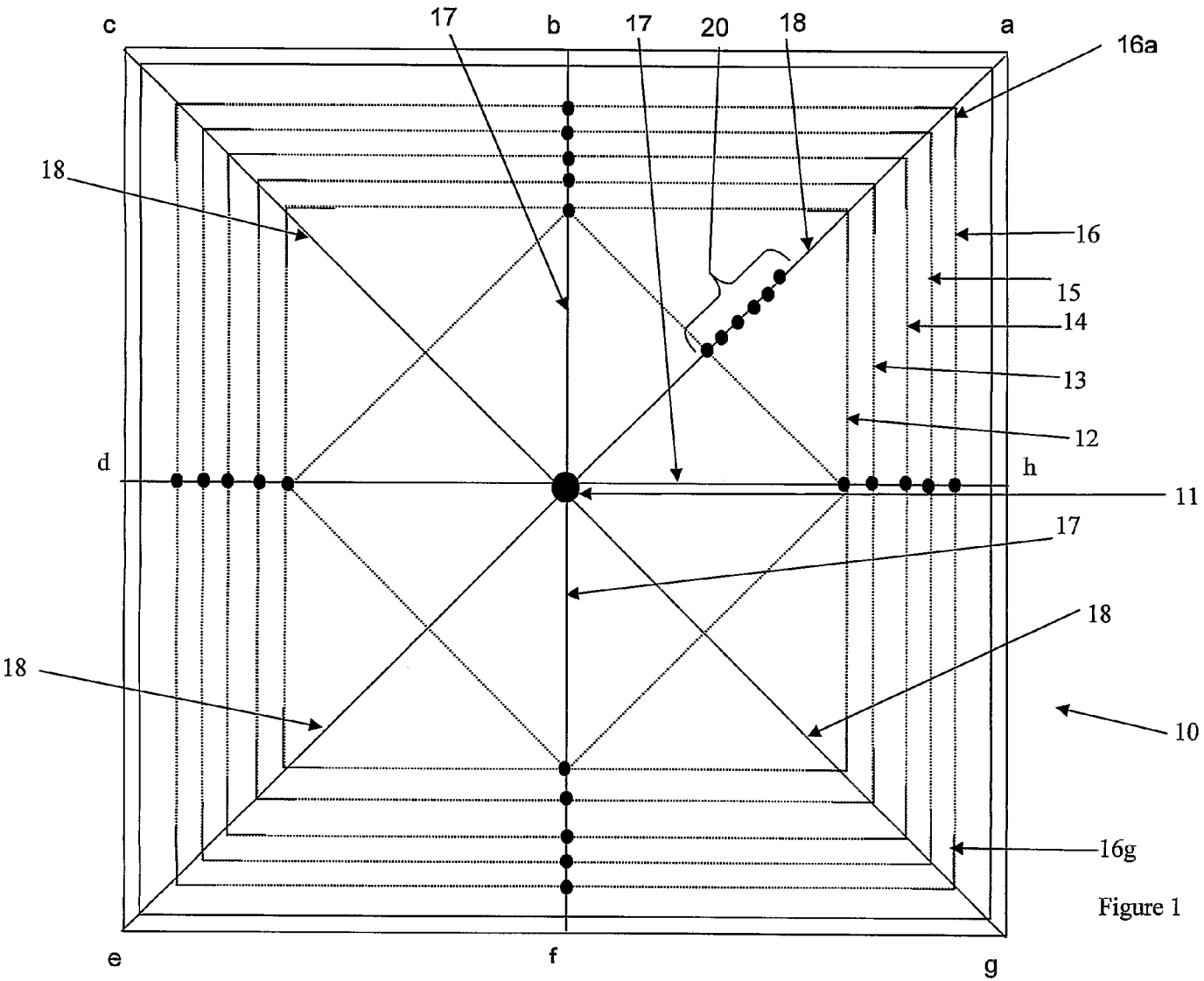
FIG. 1 is a plan view of a template device according to a preferred embodiment of the present invention.

According to an aspect of the present invention, a marking template 10 for assisting the processes of marking out prior to sewing, embroidery and particularly patchwork is provided.

The template 10 illustrated in FIG. 1 has a planar body portion with a central aperture 11 and a plurality of sets of apertures in the body portion. Each set of apertures is located a predetermined distance from the central aperture 11 which enables rectangular patterns to be marked on a workpiece.

In use, the template 10 will be laid over a piece of fabric or similar prior to cutting the fabric or sewing. A marking implement will then be used to mark the position of one or more apertures in a particular set chosen by the user to coincide with the dimensions of the workpiece.

The planar body portion of the template is manufactured of a plastic material by stamping, injection molding or cutting from a larger sheet of plastic. The plastic is transparent so the fabric or workpiece can be viewed through the template 10 when it is in place on the fabric or workpiece.

The body portion is approximately 3 mm thick. The body portion of the template is square. The body portion according to the preferred embodiment illustrated in FIG. 1 is a square having 17 inch sides.

The body portion has a central aperture 11. The central aperture 11 is a circular opening or hole extending through the body portion.

The template 10 includes a plurality of sets of apertures in the body portion. The members of a particular set are located one in each of the four cardinal directions with respect to the body portion. The sets are identified as 12, 13, 14, 15 and 16 and the members of a particular set using "$X_{superscipt}$" as appropriate. The outermost set of apertures identify a 16 inch marking zone and the subsequent sets are spaced apart in increments of ½ inch inwardly to a 12 inch marking zone.

Each particular set includes an aperture provided in both the four cardinal directions and one of the sets, set "a" has a group of apertures in the inter-cardinal direction with respect to the body portion. For example, in set 12, the members are $\mathbf{12}_a$, $\mathbf{12}_b$, $\mathbf{12}_c$, $\mathbf{12}_d$, $\mathbf{12}_e$, $\mathbf{12}_f$, $\mathbf{12}_g$, and $\mathbf{12}_h$.

The apertures located in the inter-cardinal directions ($X_a$, $X_c$, $X_e$ and $X_g$) are substantially L-shaped slots oriented concentrically with and nearest to the corner of the body portion.

There are additional markings on the body portion of the template according to the invention.

There are concentric rectangular markings on the body portion extending between the sets of apertures 12, 13, 14, 15 and 16 in the body portion, thereby identifying a standard square shape of a particular size and the bounds of the shape in all directions.

There are lines 17 marked on the body portion extending from the central aperture in each of the cardinal directions. These major markings 17 are provided at 90 degree spacings to define four major areas of the body portion. The provision of these markings also has the effect of delineating smaller square shapes on the body portion.

There are additional markings 18 provided between major markings 17 in the inter-cardinal directions. These additional markings 18 can be provided at 45 degree spacings to the major markings.

There is also a square shape marked on the template 10 with the corner points of this shape coinciding with the 12 inch apertures $\mathbf{12}_b$, $\mathbf{12}_d$, $\mathbf{12}_f$, and $\mathbf{12}_h$, on the cardinal line markings 17. The square shape therefore appears rotated 45 degrees to the other line markings on the body portion.

There are additional apertures or holes 20 on the additional inter-cardinal marking 18 located in the "a" direction.

These additional apertures 20 are spaced at increments on respective inter-cardinal lines starting from intersections of the side line of the square shape and the inter-cardinal line 18*a* to define shapes which differ by approximately ±2 inch in size and terminating inside the 12 inch markings 12 and apertures.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A marking template comprising a substantially rectangular planar body portion having a central aperture and a plurality of sets of apertures in the body portion, each set of apertures located a predetermined distance from the central aperture characterized in that an aperture of each set is provided in each of the four inter-cardinal directions with respect to the body portion, each inter-cardinal aperture of each set being an L-shaped slot oriented concentrically with, and spaced from, the respective corners of the body portion which enable rectangular patterns to be marked on a workpiece.

2. The marking template according to claim 1 wherein at least part of the planar body portion of the template is at least partially transparent so the fabric or workpiece can be viewed through the template when it is in place on the fabric or workpiece.

3. The marking template according to claim 1 wherein the body portion is square in shape, the length of each side being approximately 17 inches.

4. The marking template according to claim 1 wherein the body portion has a central aperture extending through the body portion.

5. The marking template according to claim 4 wherein additional markings are provided on the body portion in the form of lines marked extending from the central aperture in each of the cardinal and inter-cardinal directions.

6. The marking template according to claim 1 wherein the template includes a plurality of sets of apertures in the body portion, with members of each set located one in each of the four cardinal directions with respect to the body portion.

7. The marking template according to claim 1 wherein a set of apertures is provided identifying a 16 inch marking zone and further sets are spaced apart to identify progressively smaller marking zones, the zone decreasing in size by 1 inch increments to a 12 inch marking zone.

8. The marking template according to claim 1 further including at least one concentric rectangular marking on the body portion extending between the L-shaped apertures of each particular set.

9. The marking template according to claim 8 wherein one or more rectangular markings are provided on the template with the corner points of these markings coinciding with the intersection points of the innermost concentric marking and respective cardinal markings.

10. The marking template according to claim 9 further including one or more additional apertures provided at the intersection points of the one or more rectangular markings and respective inter cardinal markings.

11. The marking template according to claim 9 further including one or more additional apertures provided at the intersections of the rectangular shapes and the cardinal lines.

12. A method of forming a pattern on fabric comprising the steps of:

(a) positioning a rectangular marking template relative to the workpiece, the marking template comprising a substantially rectangular planar body portion having a central aperture and a plurality of sets of apertures in the body portion, each set of apertures located a predetermined distance from the central aperture characterized in that an aperture of each set is provided in each of the four inter-cardinal directions with respect to the body portion, each inter-cardinal aperture of each set being an L-shaped slot oriented concentrically with, and spaced from, the respective corners of the body portion which enable rectangular patterns to be marked on a workpiece, (b) marking a center position on a workpiece using the template device as aforesaid, (c) marking other strategic points on the workpiece using the L-shaped slots of at least one set, and (d) sewing onto the workpiece to a desired design or pattern.

* * * * *